United States Patent [19]

Heinold

[11] 4,030,568

[45] June 21, 1977

[54] HIGH VISIBILITY MAST FOR LIFT TRUCKS

[75] Inventor: Lloyd K. Heinold, Peoria, Ill.

[73] Assignee: Caterpillar Tractor Co., Peoria, Ill.

[22] Filed: Mar. 24, 1976

[21] Appl. No.: 670,030

[52] U.S. Cl. ..... 187/9 E

[51] Int. Cl.[2] ..... B66F 9/06

[58] Field of Search ..... 187/9 R, 9 E, 11, 17, 187/27, 95; 214/660, 670, 671, 672, 673, 674

[56] References Cited

UNITED STATES PATENTS

| | | | |
|---|---|---|---|
| 2,399,632 | 5/1946 | Guerin | 187/9 E |
| 2,456,320 | 12/1948 | Repke | 214/674 |
| 2,581,791 | 1/1952 | Gilman | 187/9 E |
| 3,127,956 | 4/1964 | Hosbein et al. | 187/9 E |
| 3,203,568 | 8/1965 | Quayle | 187/9 R X |

FOREIGN PATENTS OR APPLICATIONS

| | | | |
|---|---|---|---|
| 1,396,715 | 6/1975 | United Kingdom | 187/9 E |

*Primary Examiner*—Evon C. Blunk
*Assistant Examiner*—James L. Rowland
*Attorney, Agent, or Firm*—Phillips, Moore, Weissenberger, Lempio & Majestic

[57] ABSTRACT

A lift truck mast assembly providing unobstructed visibility for the truck operator is provided. The assembly includes a pair of spaced-apart mast uprights for supporting a load bearing carriage. Hydraulic jacks for lifting the carriage are mounted outboard of the mast uprights so that the space between such uprights is unobstructed. The mast uprights include inner and outer telescoping channel members. The inner channel members are provided with laterally extending flange plates each having a pin-receiving, locating aperture. The rod portion of each of the hydraulic jacks is equipped with a chain sheave assembly and each sheave assembly is provided with a vertically extending locator pin. Upon extension of the rod portions, the carriage is free-lifted until the locator pins are received by the flange plate apertures at which point the inner channel members are raised concurrently with the carriage relative to the outer channel members of the mast uprights.

5 Claims, 6 Drawing Figures

HIGH VISIBILITY MAST FOR LIFT TRUCKS

BACKGROUND OF THE INVENTION

The present invention relates to lift truck mast assemblies. More particularly, the present invention relates to a mast assembly which provides maximum operator visibility while concurrently providing substantial free-lift of the carriage without extension of the mast uprights.

Most commercial lift trucks have mast supported carriages which are lifted by means of hydraulic jacks, chain drives, or combinations of both systems. One problem often presented by such lift trucks is that of limited operator visibility. The usually required centralized placement of the carriage lift systems relative to the supporting mast often blocks the vision of an operator located in the cab or operator station of the lift truck.

Another problem presented by such lift trucks is that of excessive unextended mast height. Lift trucks are often required to negotiate tight turns in limited ceiling areas. This requires that such vehicles present a relatively low profile and low center of gravity when moving from one load space to another. However, by providing a relatively low fixed mast assembly to increase low ceiling maneuverability, the maximum lift height for loading may be prohibitively restricted.

Some attempts have been made in the prior art to address both of these problems. Examples of such prior art attempts are found in U.S. Pat. Nos. 3,394,778; 3,127,956; 2,581,791; and 2,456,320, to Brinton, Hosbein, et al; Gilman; and Repke, respectively. None of these patents, however, disclose inventions which simultaneously solve the noted problems while at the same time providing a relatively inexpensively fabricatable, extremely efficient and functional mast assembly.

The present invention simultaneously improves operator visibility while providing a mast assembly having a low profile during maneuvering with high extension capability when desired.

SUMMARY AND OBJECTS OF THE INVENTION

The instant invention comprises a mast assembly for a lift truck having a pair of spaced-apart mast uprights for supporting a load carriage. The carriage is lifted by a pair of hydraulic jacks disposed respectively outboard of the mast uprights. The area between the uprights is unobstructed to maximize operator visibility. The mast uprights include outer fixed channel members and telescoping inner movable channel members. The inner channel members are provided with laterally extending flange plates having apertures. Rod portions of the carriage lifting hydraulic jack assemblies are equipped with locator pins. Upon extension of the hydraulic jacks, the carriage is free-lifted until the locator pins engage the flange plate apertures. Thereafter, the carriage and inner channel members are driven concurrently by the hydraulic jacks.

A primary object of the present invention is to provide a mast assembly for a lift truck which does not obstruct operator visibility.

Another object of the present invention is to provide a mast assembly having a pair of upstanding mast uprights and having a pair of carriage lifting hydraulic jack assemblies disposed entirely outboard of such mast uprights.

Still another object of the present invention is to provide a lift truck mast assembly having a substantial capacity to free-lift the carriage without extension of the uprights.

A further object of the present invention is to provide a mast assembly having uprights made up of telescoping inner and outer channel members and having a combination chain-hydraulic lifting system for the carriage.

Another object of the present invention is to provide the above-described mast assembly with a chain sheave assembly mounted on the rod portions of each hydraulic jack and with a flange plate member attached to each inner channel member.

A still further object of the present invention is to provide the above-described mast assembly with pin means for engaging each flange plate member mounted upon each sheave assembly.

Other objects and advantages of the present invention will become readily apparent from the following description and drawings.

DETAILED DESCRIPTION

Figure 1:
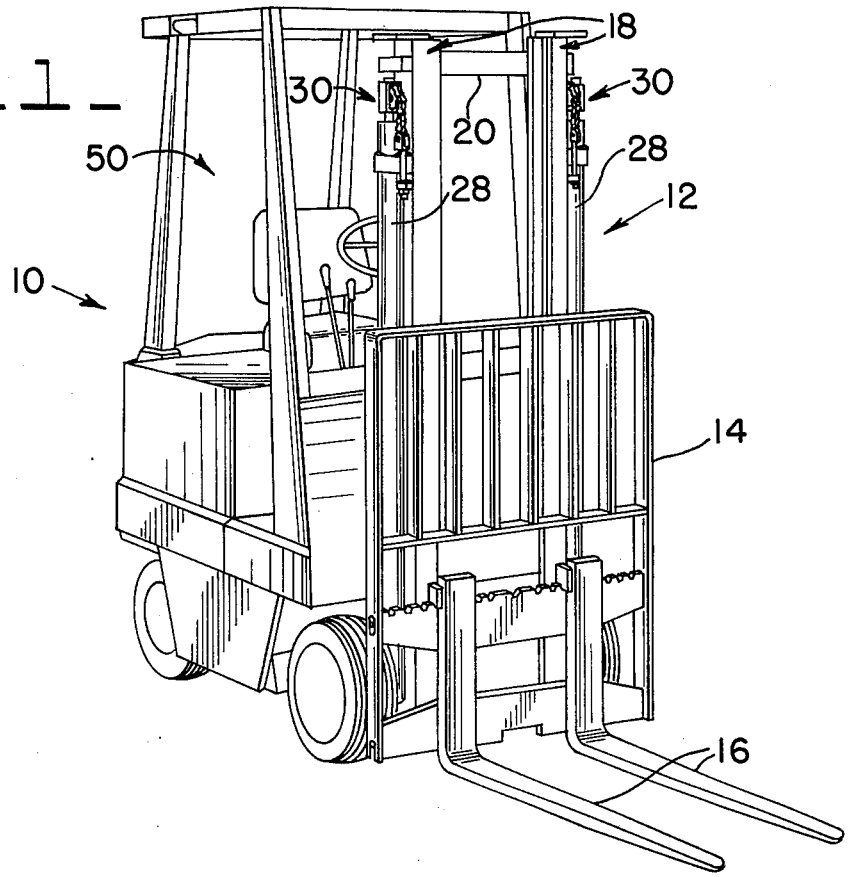
FIG. 1 is an isometric view of a lift truck equipped with the novel mast assembly of the present invention.

As seen in FIG. 1, the mast assembly of the present invention is designed for use with an industrial lift truck generally indicated at 10. The details of the truck, such as the transmission, engine, etc., are not part of the present invention, and therefore are not described in detail. A mast assembly 12 is mounted in a generally vertical plane on the front end of the truck as best seen in FIG. 1.

Figure 3:
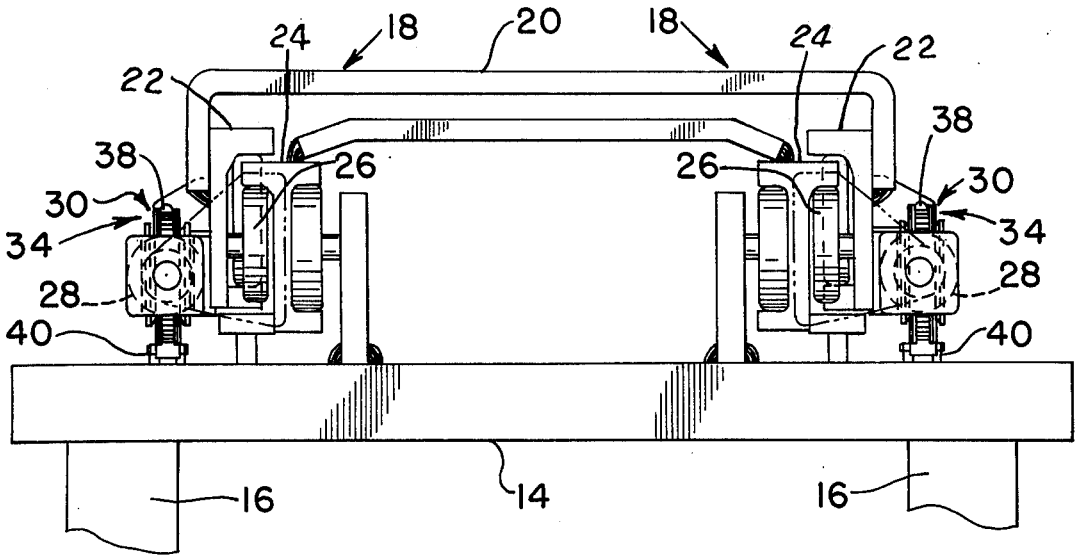
FIG. 3 is a top plan view of the mast assembly of FIG. 2.

The mast assembly includes a carriage assembly 14 upon which are mounted a pair of outwardly extending load forks 16. The carriage assembly is movably mounted upon a pair of upstanding mast uprights 18, which uprights are pivotally secured relative to the truck frame structure by pivots (not shown). The mast uprights are spaced and supported relative to one another by means of a wrap-around tie bar or cross brace 20, as best shown in FIG. 3.

Each of the mast uprights 18 includes an outer mast in the form of a channel member 22, which is vertically fixed relative to the truck frame structure, and an inner mast in the form of a channel member 24 which is telescopically received within the outer mast 22 and which is supported for movement with respect to such outer mast by means of roller 26.

Figure 2:
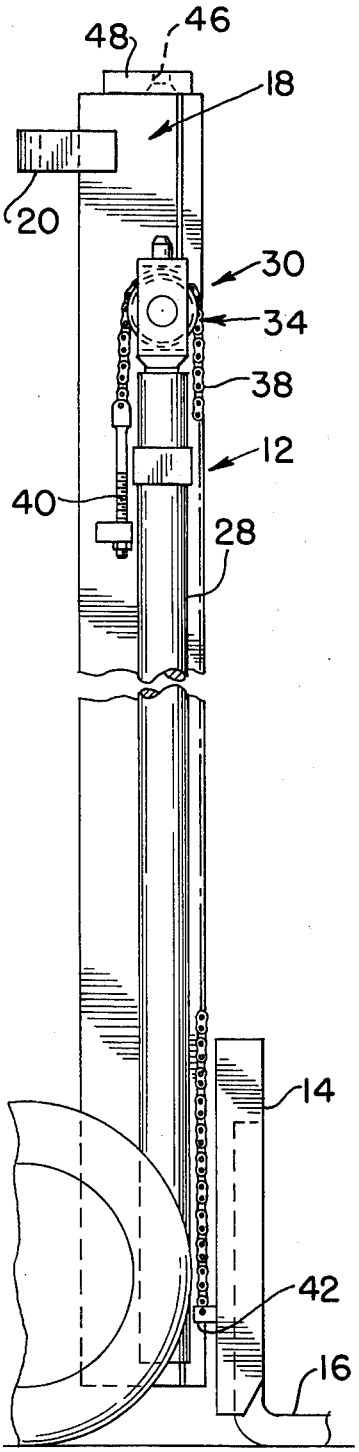
FIG. 2 is a partial elevation of the mast assembly shown in FIG. 1.

The carriage lifting mechanism includes a pair of lift cylinders in the form of hydraulic jacks 28 and associated chain assemblies shown generally at 30. With particular reference to FIG. 2, it will be noted that the cylinders of each of the jacks 28 are fixed to the outer channel members 22 as by welding or other convenient means. The extensible rods 32 of the jacks are each provided with a sheave assembly shown generally at 34.

Each sheave assembly includes a sheave or roller 36 over which is reeved a chain 38. One end of such chain is adjustably affixed, by suitable threaded connector means, to the outer channel member 22 as at 40. The other end of the chain is connected at 42 to a portion of the carriage assembly 14. As is apparent from an inspection of FIG. 2, upon vertical extension of the rod and sheave assembly, the chain 38 will exert a lifting force upon the carriage at the point 42.

Figure 4:
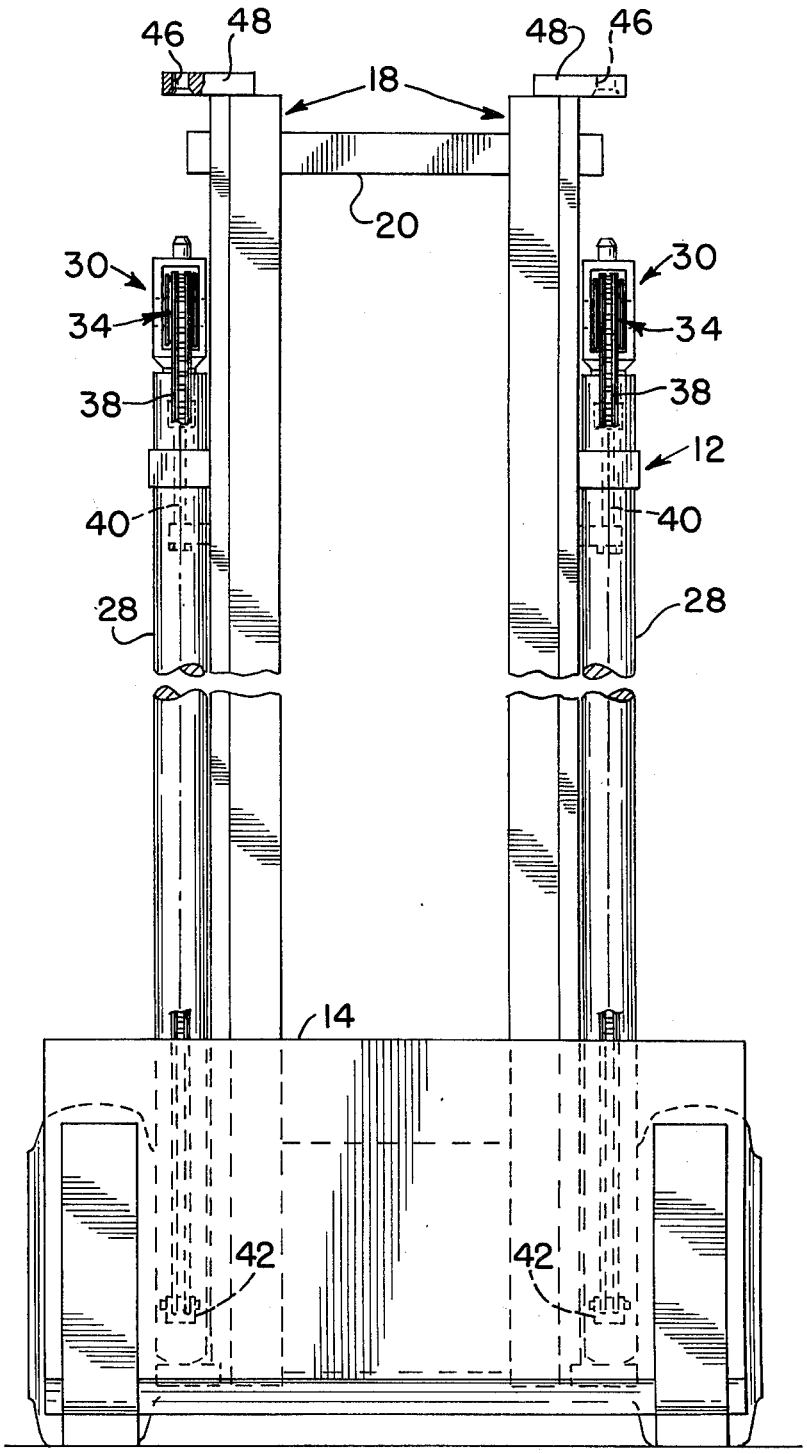
FIG. 4 is a partial elevation view of the lift truck of FIG. 1.

Turning to FIG. 4, it may be seen that the jacks 28 and associate chain assemblies, being mounted entirely outwardly of the mast uprights, do not in any way obstruct the area between such uprights through which operator visibility is provided. As seen in FIGS. 2, 3 and 4, assemblies 34 are of generally rectangular configuration and they do not extend laterally beyond the confines of the lift cylinders.

Affixed to the top of each sheave assembly 34 is a hardened steel locator pin 44 in the form of a chamfered dowel. The pin is adapted to cooperate with a locator aperture 46 in flange plate 48 extending laterally outwardly from each of of the inner channel members 24. The flange plates 48 are preferably rectangular in shape and are welded directly to the inner channel members 24.

Figure 5:
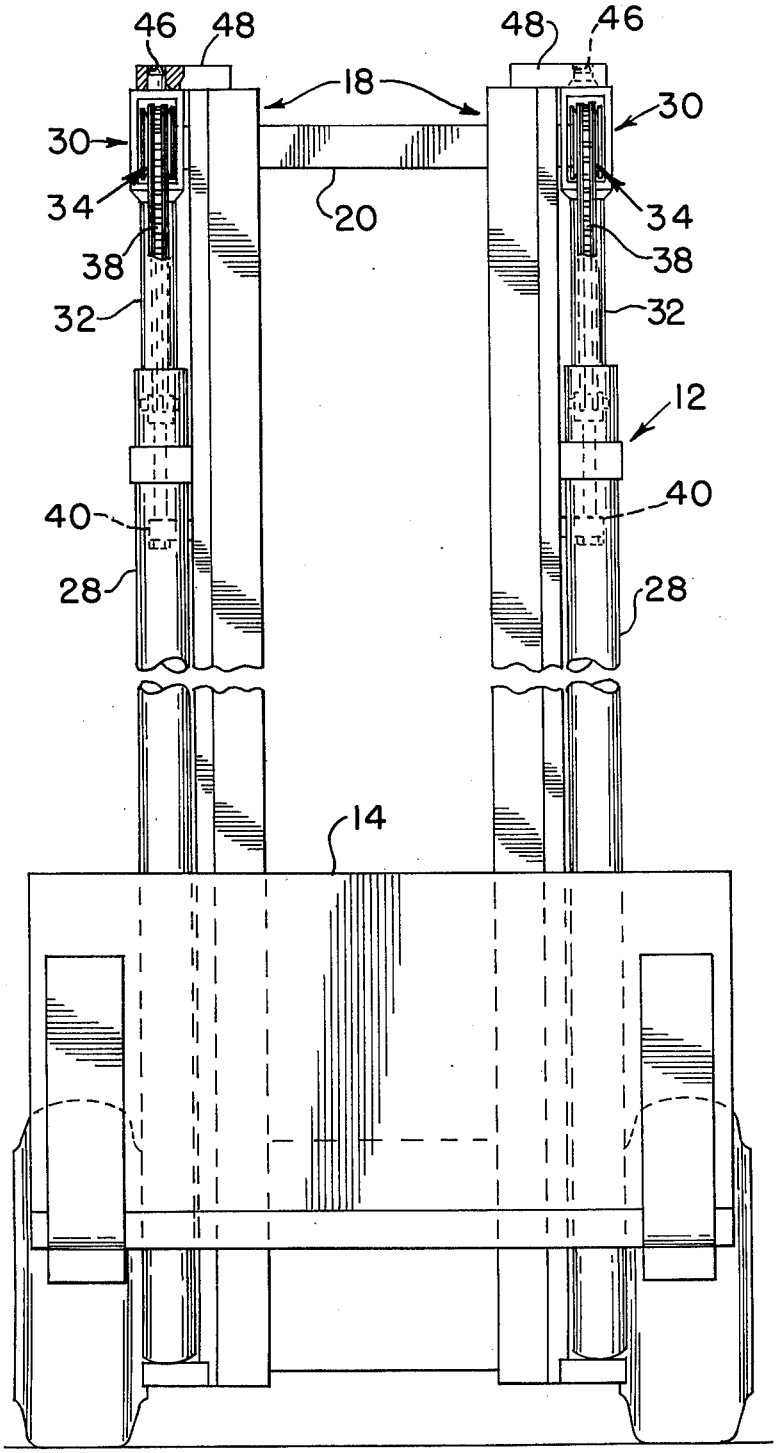
FIG. 5 is a view similar to FIG. 4, but showing the hydraulic jacks in partially extended position; and, FIG. 6 is an enlarged partial view of the mast assembly in fully extended position.
Figure 6:
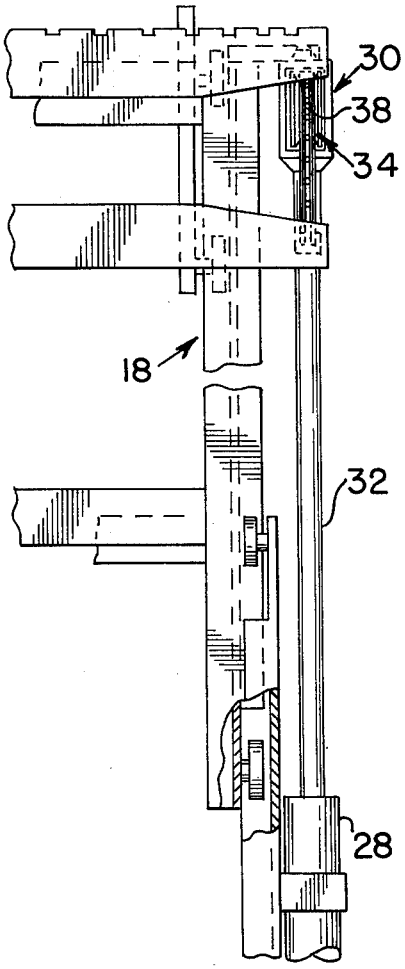

In operation, when it is desired to lift the carriage assembly, suitable control means in the operator station 50 of the lift truck causes the activation of the hydraulic lift jacks 28. The rods portions thereof and the associated sheave assemblies extend vertically upwardly causing the chain 38 to pass over the sheaves 36 and exert a lifting force on the carriage assembly. Initially, continued extension of the jacks causes a proportional change in the vertical position of the carriage assembly without movement of the inner channel members 24 of the mast uprights. However, at such time as the locator pins 44 engage the apertures 46, as shown in FIG. 5, the flange plates 48 transmit lifting forces to the inner channel members 24 and such channel members extend upwardly from the outer channel members 22 and are lifted concurrently with the carriage, as shown in FIG. 6. Such extension of the inner channel members affords firm support for the loaded carriage as it ascends to maximum height. However, by providing a substantial initial period of free-lift, i.e., wherein extension of the hydraulic jacks causes movement on only the carriage, the load carriage may be advantageously fully supported at all vertical lift positions while the overall height of the truck and mast uprights are not increased. This allows the operation of the loaded truck in areas of low overhead.

It is to be understood that the foregoing description is merely illustrative of the preferred embodiment of the invention and that the scope of the invention is not to be limited thereto, but is to be determined by the scope of the appended claims.

What is claimed is:

1. In a lift truck, a mast assembly supported on said truck, said mast assembly comprising: a pair of vertically extending laterally spaced-apart mast uprights, said mast uprights each including inner and outer relatively movable telescoping members, load bearing carriage means including forks thereon supporting a load to be lifted, said carriage means being movably mounted upon said mast uprights, carriage lift actuator means mounted upon said mast uprights for selectively moving said carriage means relative to said outer members, said lift actuator means being mounted upon said mast uprights entirely laterally outwardly thereof, thereby leaving the space between said mast uprights unobstructed for good operator visibility, said actuator means including a pair of hydraulic jacks having cylinder portions and rod portions extendible from said cylinder portions, said cyliner portions being fixedly mounted upon said outer members, and chain means connected at first and second points to said outer members and said carriage, respectively, sheave assembly means for said chain means, said sheave assembly means being mounted upon and movable with said rod portions of said hydraulic jacks, wherein said sheave assembly means include a sheave support member and vertically extending pin means and flange plate means mounted upon said inner members for engaging said pin means upon extension of said rod portions to transmit movement of said rod portions to said inner members.

2. The invention of claim 1 wherein said pin means include a chamfered dowel and wherein said flange plate means include an aperture for loading and receiving said chamfered dowel.

3. The invention of claim 1 wherein said inner and outer telescoping members are channel members mounted for movement relative to one another by roller means.

4. The invention of claim 3 wherein said roller means comprise rollers mounted on said members.

5. The invention of claim 3 wherein said sheave assembly means comprise a roller and wherein said chain is reeved over said roller.

* * * * *